US008651119B2

(12) United States Patent
Byun

(10) Patent No.: US 8,651,119 B2
(45) Date of Patent: Feb. 18, 2014

(54) COSMETIC CASE FOR POWDER

(76) Inventor: Young-Kwang Byun, Seoul (KR)

( * ) Notice: Subject to any disclaimer, the term of this patent is extended or adjusted under 35 U.S.C. 154(b) by 0 days.

(21) Appl. No.: 13/364,990

(22) Filed: Feb. 2, 2012

(65) Prior Publication Data

US 2013/0118521 A1 May 16, 2013

(30) Foreign Application Priority Data

Nov. 15, 2011 (KR) ..... 10-2011-0119029

(51) Int. Cl.
*A45D 33/02* (2006.01)

(52) U.S. Cl.
USPC ..... 132/294; 132/298; 206/823; 206/581

(58) Field of Classification Search
USPC ..... 132/293, 294, 298, 299, 300, 305, 306, 132/307, 314; 206/823, 581, 235, 15.2, 206/704, 533; 222/142.9, 480, 565
See application file for complete search history.

(56) References Cited

U.S. PATENT DOCUMENTS

| | | | | | |
|---|---|---|---|---|---|
| 2,476,686 | A * | 7/1949 | Smith et al. | 401/191 |
| 2,975,887 | A * | 3/1961 | Weingart | 206/533 |
| 3,020,659 | A * | 2/1962 | Paulini | 40/307 |
| 3,467,287 | A * | 9/1969 | McHardy et al. | 222/480 |
| 4,653,672 | A * | 3/1987 | Tuerk et al. | 222/153.14 |
| 4,777,969 | A * | 10/1988 | Holloway | 132/314 |
| 5,123,574 | A * | 6/1992 | Poulos | 222/362 |
| 5,601,213 | A * | 2/1997 | Daniello | 222/456 |
| 5,845,816 | A * | 12/1998 | Krane | 222/142.9 |
| 6,009,885 | A * | 1/2000 | Nam | 132/293 |
| 6,073,634 | A * | 6/2000 | Gueret | 132/218 |
| 6,298,863 | B1 * | 10/2001 | Byun | 132/294 |
| 6,978,790 | B2 * | 12/2005 | Byun | 132/287 |
| 7,083,354 | B2 * | 8/2006 | Byun | 401/263 |
| 7,093,739 | B2 * | 8/2006 | Byun | 222/390 |
| 7,494,030 | B2 * | 2/2009 | Bennett | 222/480 |
| 7,726,322 | B2 * | 6/2010 | Cho | 132/294 |
| 7,743,775 | B2 * | 6/2010 | Thiebaut | 132/294 |
| 8,066,019 | B2 * | 11/2011 | Zhu et al. | 132/299 |
| 8,235,059 | B2 * | 8/2012 | Pires et al. | 132/299 |
| 2004/0173234 | A1 * | 9/2004 | Byun | 132/287 |
| 2005/0011806 | A1 * | 1/2005 | Byun | 206/581 |
| 2008/0178903 | A1 * | 7/2008 | Thorpe et al. | 132/307 |
| 2010/0307521 | A1 * | 12/2010 | Pires et al. | 132/200 |

FOREIGN PATENT DOCUMENTS

| | | |
|---|---|---|
| KR | 1994-0032824 | 11/1996 |
| KR | 1996-000198 | 8/1997 |
| KR | 20-2000-0021237 | 10/2000 |
| KR | 20-2006-0023846 | 11/2006 |

* cited by examiner

*Primary Examiner* — Robyn Doan
*Assistant Examiner* — Tatiana Nobrega
(74) *Attorney, Agent, or Firm* — Kaplan Breyer Schwarz & Ottesen, LLP

(57) ABSTRACT

A cosmetic powder brush is provided. A brush holder is provided with a brush insertion part in which a brush is stored, and is rotatably coupled to a cap. The brush is stored in the brush insertion part, and then, the brush holder is rotated through a certain angle to prevent a removal of the brush in a closed state, and the brush holder is rotated through the certain angle to an original position thereof to use the brush, and the brush is taken out in an open state. The brush holder is rotatably installed on the cap, and the brush is inserted and stored in the brush holder, thereby effectively preventing the brush from being lost.

4 Claims, 7 Drawing Sheets

COSMETIC CASE FOR POWDER

CROSS-REFERENCE TO RELATED APPLICATIONS

Korean patent application KR 10-2011-0119029, filed Nov. 15, 2011, is incorporated herein by reference.

FIELD OF THE INVENTION

The present invention relates to a cosmetic case for powder, and more particularly, to a cosmetic powder case which securely stores a makeup brush that is taken out and conveniently used for a makeup.

DESCRIPTION OF THE RELATED ART

Recently, the demand of functional cosmetics increases over the world, and new materials and formulations are successively developed.

Accordingly, cosmetic cases for maximally protecting the functions of effective components and providing use convenience are actively developed.

Cosmetics may be classified into solid type cosmetics and solid/liquid type cosmetics. There are a number of cosmetics having various functions and forms, such as makeup bases, eye shadows, two way cakes, powder pacts, and skin covers, according to users' tastes and skin conditions.

A makeup cosmetic may be formed by injecting an oily powder source into a case, and then pressing the source with a press. Such makeup cosmetics may be typically compressed to a solid state. Particularly, powder sources may be formed by mixing a coloring matter, a binder, and a base material such as talc, titanium dioxide, mica, silica, nylon powder, poly methyl methacrylate, sericite, kaolin, or bismuth oxychloride. In this case, the binder may be selected from the group consisting of silicone-based oil, hydrocarbon-based oil, advanced fatty acid-based oil, high alcoholic oil, ester-based oil, glyceride-based oil, lanoline-based oil, animal oil, and vegetable oil.

Cosmetics compressed in a solid state may be applied to a user's face by using a cosmetic puff. In this case, the amount of a cosmetic attached to the puff may be varied. In addition, an amount of the cosmetic applied initially to the face may be greater than that of the cosmetic applied later to the face. As a result, the cosmetic is unevenly applied to the face.

To address this limitation, a cosmetic case may be filled with cosmetic powder, and an opening of the case may be closed with a puff, so that the powder can be uniformly discharged through the puff.

A cosmetic case disclosed in Korean Utility Model Registration No. 20-0431987 includes: a lower body including a storing space therein; an upper body coupled to the top of the lower body; a storing case coupled to an inner portion of the upper body; and an opening/closing cover coupled to the upper body. A support plate is coupled to the inner portion of the cover, and includes a leaf spring on the rear surface thereof to apply elastic force to the outside. A packing member formed of at least one of rubber, silicone, and soft synthetic resin to provide a sealing function is coupled to the front edge of the support plate, and protrude forward.

However, typical cosmetic powder cases do not have a brush storage. Even when a cosmetic powder case has a brush storage, the brush may be accidentally removed and lost from the cosmetic power case.

A compact cosmetic case assembly disclosed in Korean Examined Utility Model Publication No. 1996-0008289 includes: a hollow case including a screw thread 11 on the outer surface thereof; a partition plate removably coupled to the case, and having a surface with holes; a puff placed on the partition plate; an inner cover including a screw thread engaging with the screw thread of the case; an upper cover coupled to the inner cover, and integrally including a storage having a certain shape that is formed by cutting a certain portion of a plane and a circumferential surface; and a cosmetic brush assembly removably inserted in the storage and having a shape corresponding to the storage.

In addition, a cosmetic case assembly disclosed in Korean Utility Model Laid-open Publication No. 1997-048837 includes: a cosmetic brush; a slider fixing an end of the cosmetic brush; and a case in which the slider can moves, and the cosmetic brush is pushed in and pulled out according to moving positions of the slider.

In addition, a cosmetic case disclosed in Korean Utility Model Registration No. 20-0209938 includes: a body including a hollow part at the upper portion thereof to receive a certain amount of contents, and including a brush storage at the lower inner portion thereof to store a brush; an opening/closing cover hinged to the upper side of the body, and including a seeing through window in the center thereof to perceive the contents with a naked eye, and including a fit recess at an upper side opposed to a hinge portion thereof, wherein a folded portion of a brush is fitted in the fit recess to close the hollow part; and the brush including a protective cap covering bristles and a grip to protect the bristles, and stored in the brush storage of the body. The folded portion is fitted in the cover, to thereby couple the body to the cover.

However, such cosmetic cases have a complicated brush storage, and thus, mold costs thereof are high, and the brush may be accidentally removed and lost.

SUMMARY OF THE INVENTION

Accordingly, the present invention is directed to a cosmetic powder case, which substantially obviates one or more problems due to limitations and disadvantages of the related art.

An object of the present invention is to provide a cosmetic powder case, in which a brush holder is rotatably installed on a cap, and a brush is inserted and stored in the brush holder, thereby effectively preventing the brush from being lost. In addition, the brush can be conveniently taken out for a makeup.

Another object of the present invention is to provide a cosmetic powder case, in which a brush can be inserted and stored in a brush insertion part of a brush holder. Since a handle of the brush is exposed out of the brush holder, the handle can be pressed and be easily taken out with a user's hand. In addition, a tension piece makes it possible to securely store the brush in the brush insertion part without a movement. In addition, a structure for storing the brush is simplified, to thereby significantly decrease mold costs.

According to an aspect of the present invention, there is provided a cosmetic powder case including: a cylindrical case main body storing powder, and including a male screw part along an upper circumferential surface thereof, and a stop protrusion in an upper portion thereof; a sifter supported by the stop protrusion and coupled to the upper portion of the case main body, the sifter including powder discharge holes in a bottom surface thereof, a puff being placed on the bottom surface; a cap including a female screw part along an inner circumferential surface thereof to couple to the upper portion of the case main body, a rotation guide along an outer top surface thereof, and a guide recess in an inner surface of the rotation guide; a brush holder rotatably coupled to an inner portion of the rotation guide, and including a guide protrusion on an outer circumferential surface thereof to correspond to the guide recess, and a brush insertion part in an upper portion thereof; and a brush including a handle and hairs fixed to the handle, and inserted and stored in the brush insertion part, the brush being selectively pulled out and used, wherein openings are formed in left and right portions of the rotation guide, a brush inlet and a brush outlet are formed at left and right sides of the brush receiver part to correspond the openings, an exposure hole is formed in an upper portion of the brush insertion part to expose the handle of the brush out of the brush holder, so that the brush is taken out, the handle exposed through the exposure hole is pressed and pushed with a user's hand to slide the brush, whereby the brush is taken out from the brush holder.

When the openings, the brush inlet, and the brush outlet are aligned in a left and right direction in a bush open state, the brush may be slid and taken out from the brush holder, and when the openings, the brush inlet, and the brush outlet are not aligned in the left and right direction in a brush closed state, the brush may be prevented from being accidentally removed from the brush insertion part.

A flange contacting the rotation guide may be formed at an upper edge of the brush holder, a knurling portion may be formed on an outer surface of the flange, and an insertion recess may be formed above the guide recess to insert the guide protrusion into the guide recess when the brush holder is coupled to the inner portion of the rotation guide.

A tension piece for fixing the brush may be formed on a bottom surface of the brush insertion part, a fixing recess may be formed in the handle to correspond to the tension piece, an aligning recess for guiding sliding of the brush may be formed on a center line of the handle, and a fixing protrusion for fixing the guide protrusion may be formed on a bottom of the guide recess.

DETAILED DESCRIPTION OF THE INVENTION

Reference will now be made in detail to the preferred embodiments of the present invention, examples of which are illustrated in the accompanying drawings.

Figure 1:
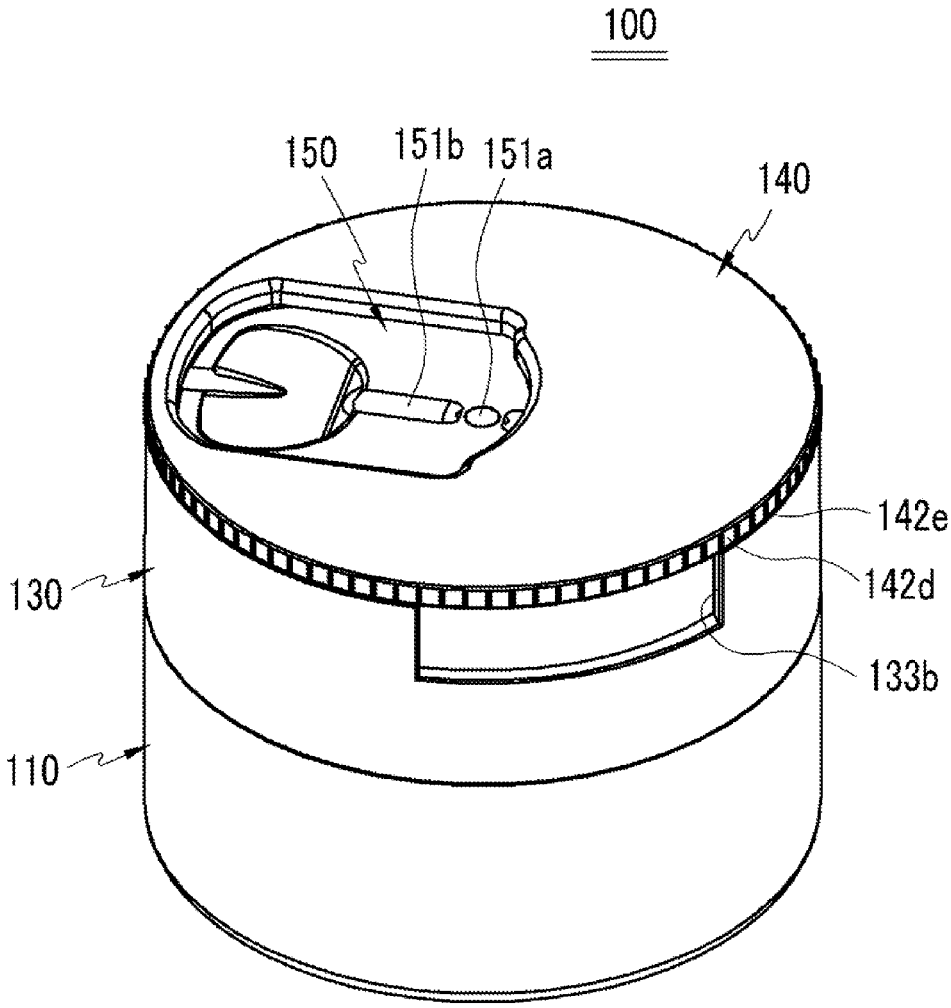
FIG. 1 is a perspective view illustrating a cosmetic powder case, according to an embodiment of the present invention.
Figure 2:
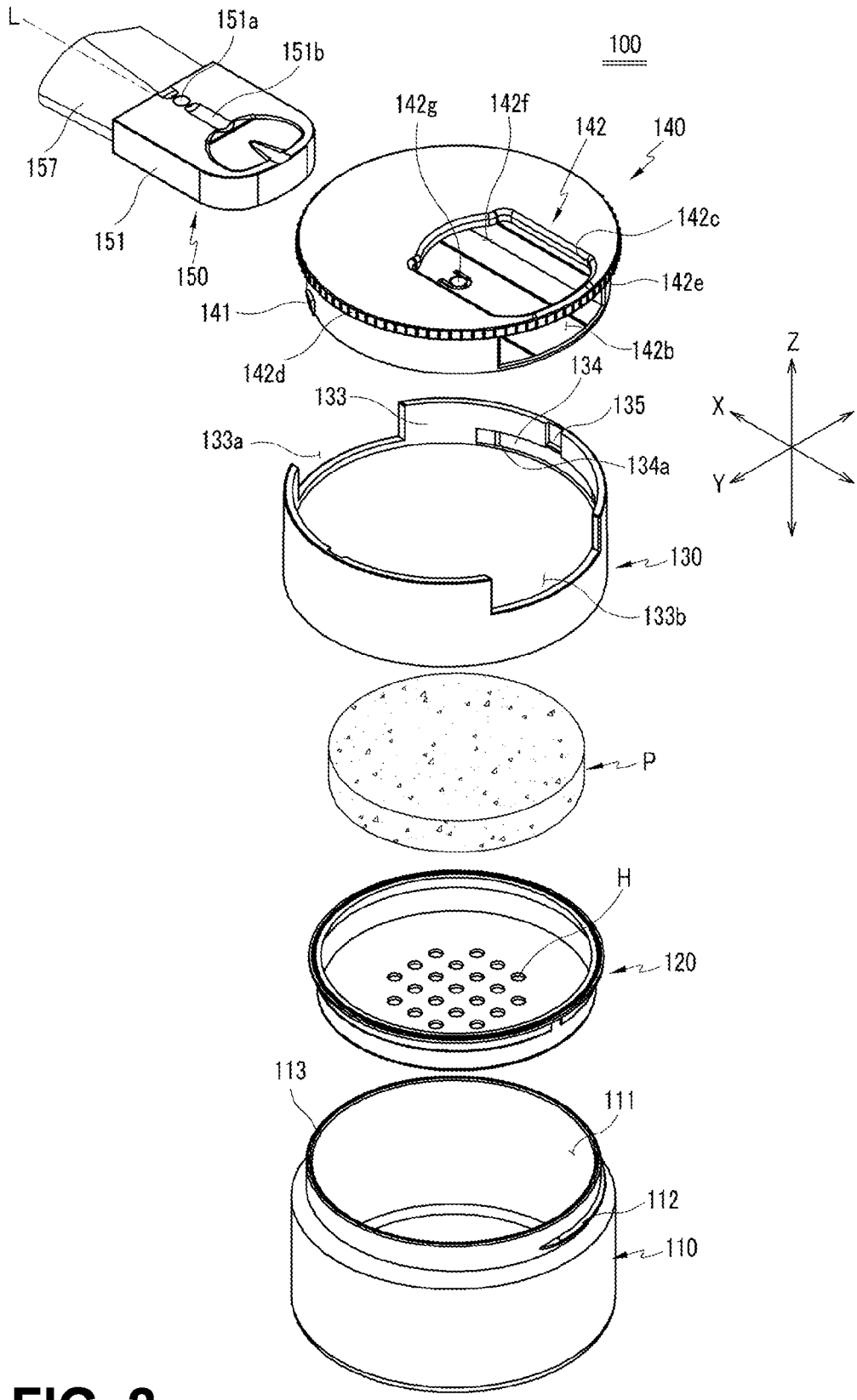
FIG. 2 is an exploded view illustrating a cosmetic powder case according to an embodiment of the present invention.
Figure 3:
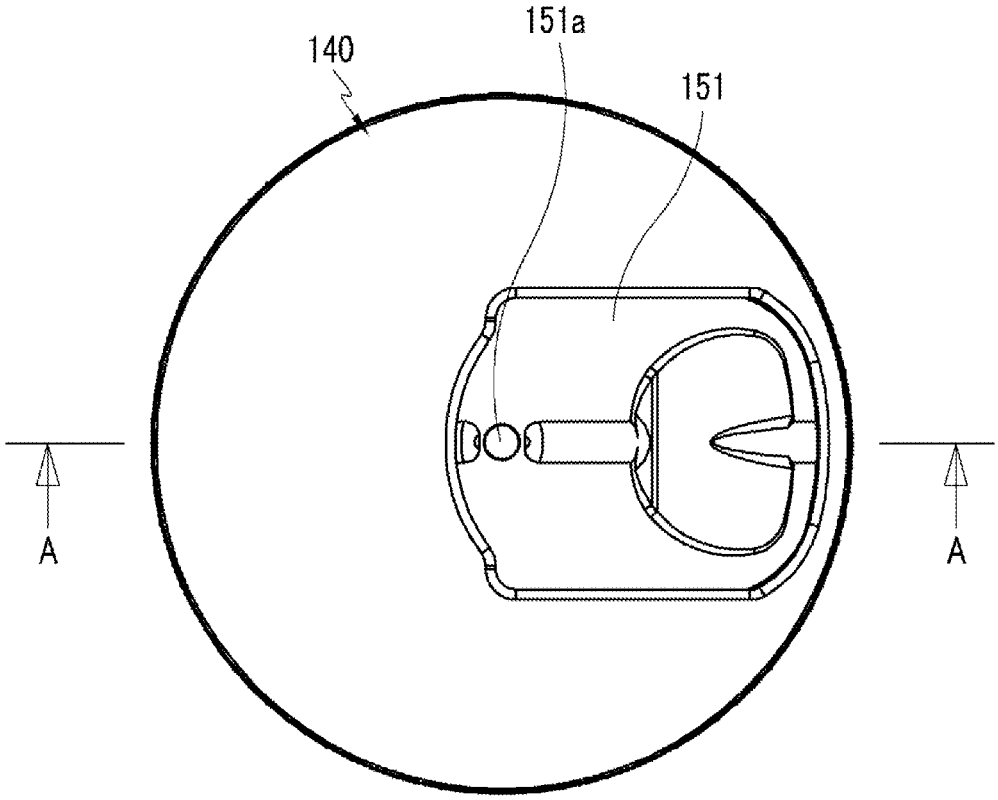
FIG. 3 is a plan view illustrating a cosmetic powder case according to an embodiment of the present invention.
Figure 4:
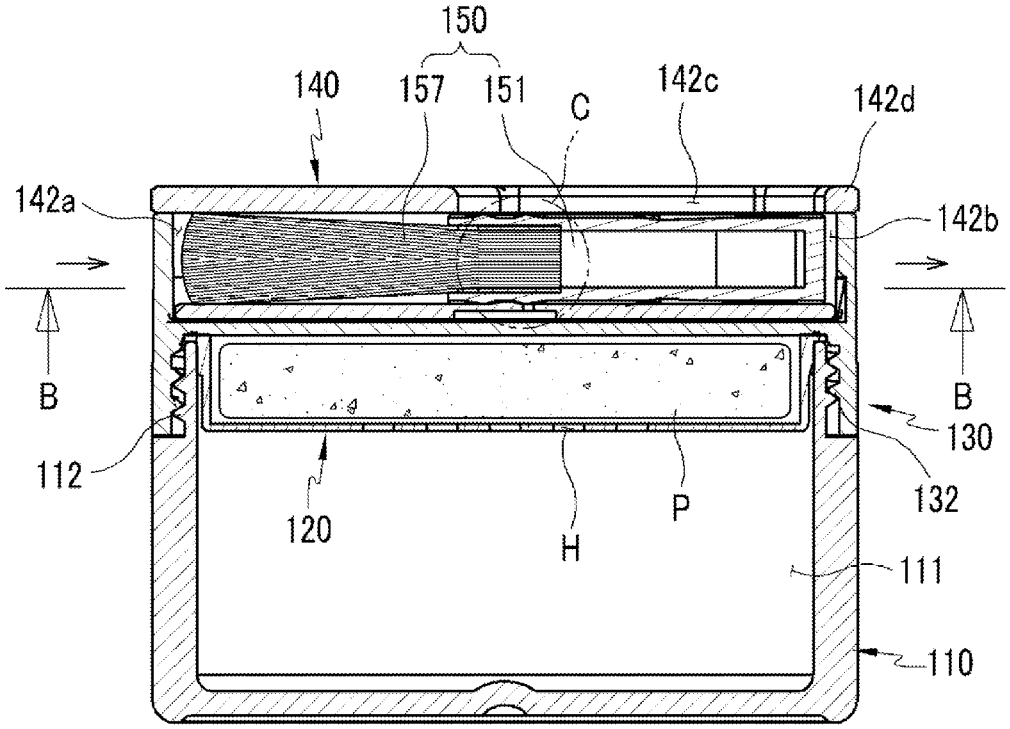
FIG. 4 is a cross-sectional view taken along line A-A' of FIG. 3.
Figure 5:
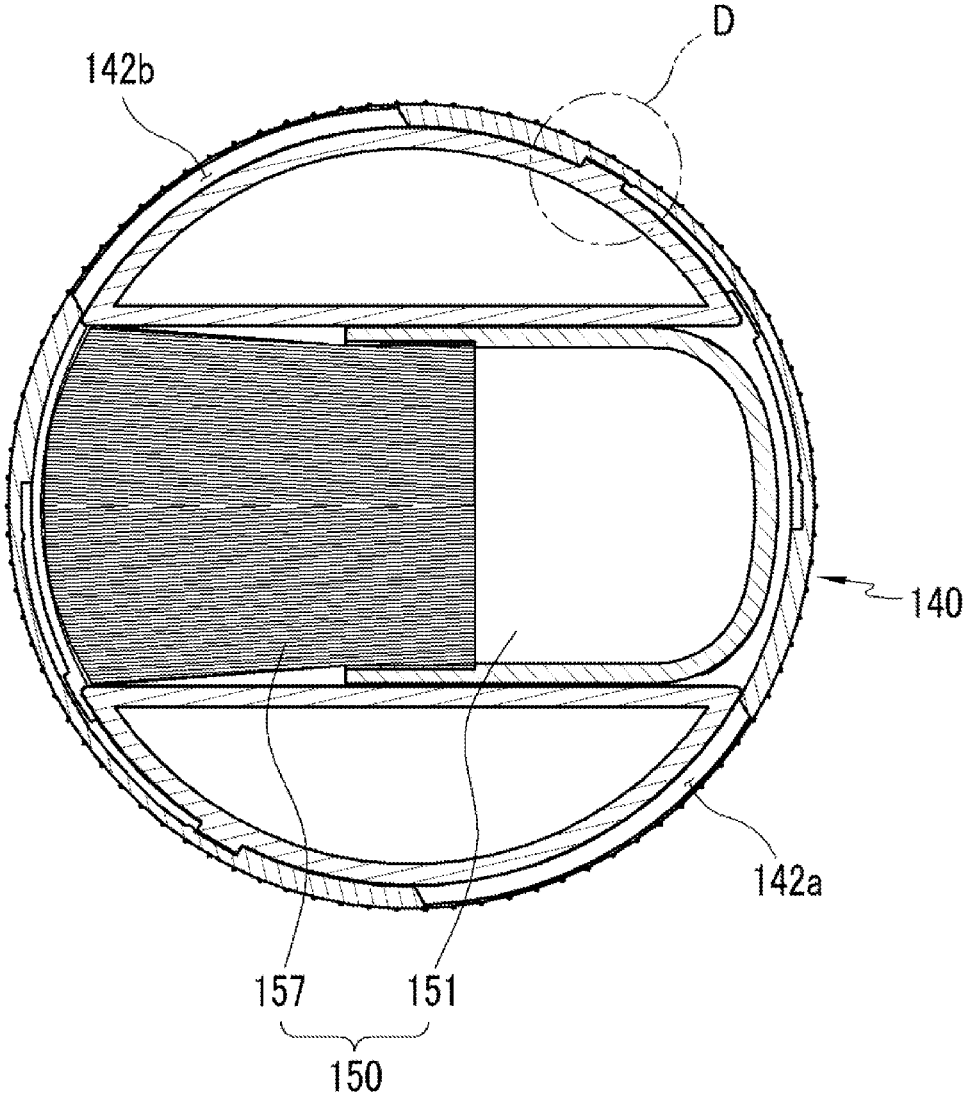
FIG. 5 is a cross-sectional view taken along line B-B' of FIG. 4.
Figure 6:
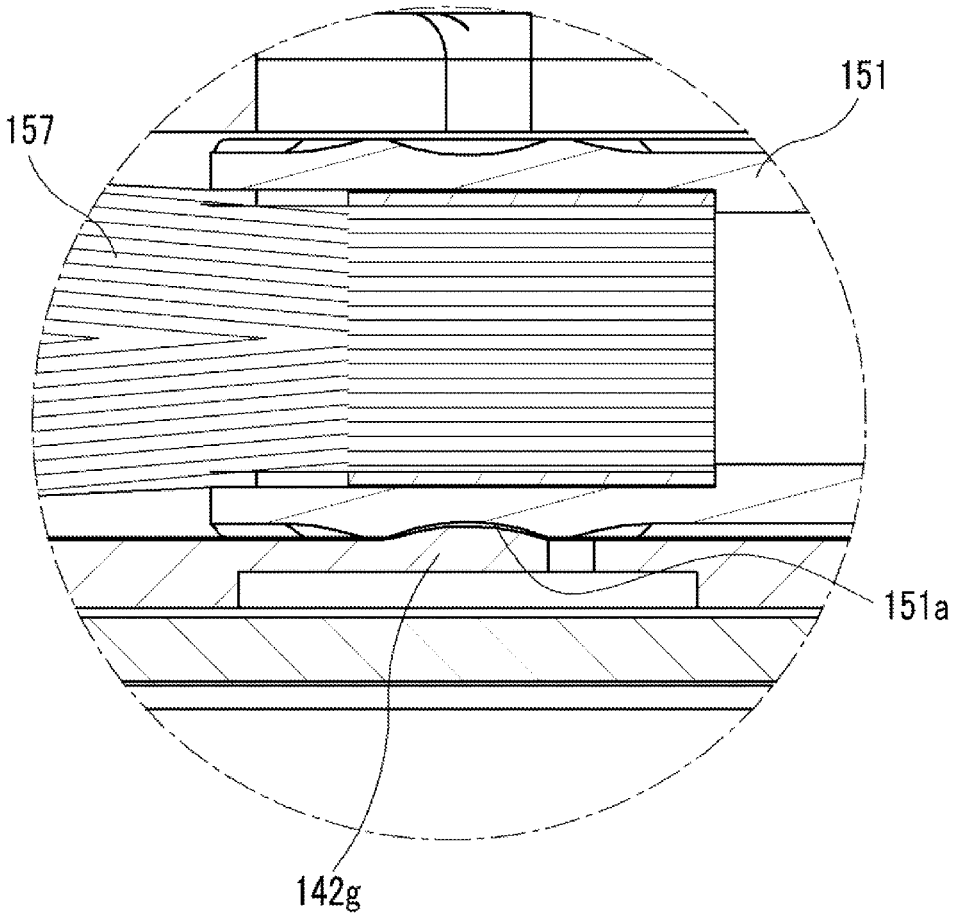
FIG. 6 is an enlarged view illustrating a portion C of FIG. 4.
Figure 7:
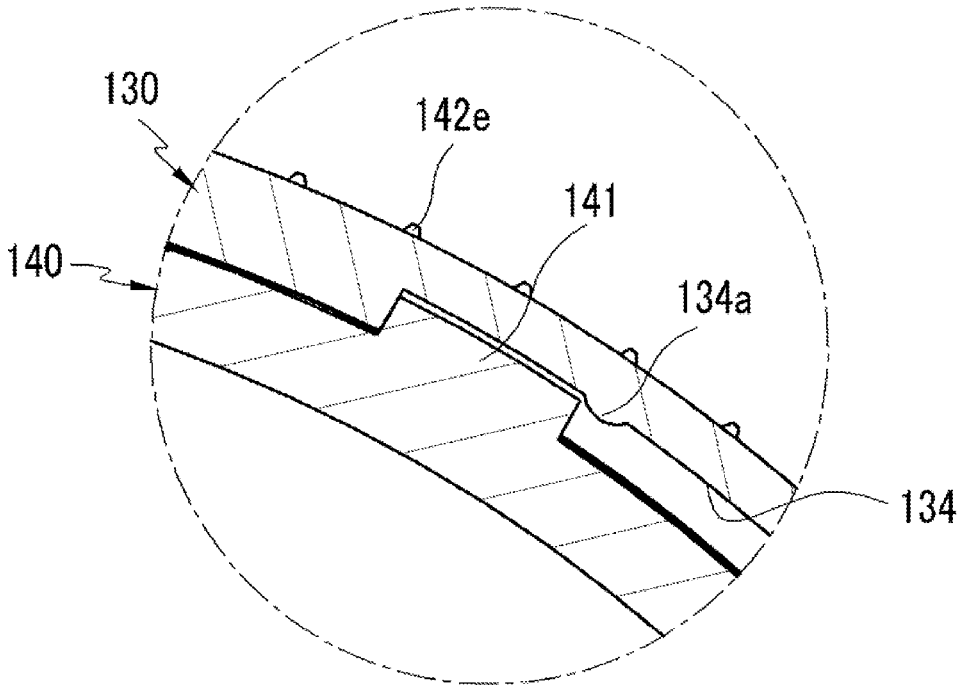
FIG. 7 is an enlarged view illustrating a portion D of FIG. 5.

FIG. 1 is a perspective view illustrating a cosmetic powder case, according to an embodiment of the present invention. FIG. 2 is an exploded view illustrating a cosmetic powder case according to an embodiment of the present invention. FIG. 3 is a plan view illustrating a cosmetic powder case according to an embodiment of the present invention. FIG. 4 is a cross-sectional view taken along line A-A' of FIG. 3. FIG. 5 is a cross-sectional view taken along line B-B' of FIG. 4. FIG. 6 is an enlarged view illustrating a portion C of FIG. 4. FIG. 7 is an enlarged view illustrating a portion D of FIG. 5.

Referring to FIGS. 1 to 7, a cosmetic powder case 100 according to an embodiment of the present invention includes: a cylindrical case main body 110 storing powder, and including a male screw part 112 along an upper circumferential surface thereof, and a stop protrusion 113 in an upper portion thereof; a sifter 120 supported by the stop protrusion 113 and coupled to the upper portion of the case main body 110, the sifter 120 including powder discharge holes H in a bottom surface thereof, a puff P being placed on the bottom surface; a cap 130 including a female screw part 132 along an inner circumferential surface thereof to couple to the upper portion of the case main body 110, a rotation guide 133 along an outer top surface thereof, and a guide recess 134 in an inner surface of the rotation guide 133; a brush holder 140 rotatably coupled to an inner portion of the rotation guide 133, and including a guide protrusion 141 on an outer circumferential surface thereof to correspond to the guide recess 134, and a brush insertion part 142 in an upper portion thereof; and a brush 150 including a handle 151 and hairs 157 fixed to the handle 151, and inserted and stored in the brush insertion part 142, the brush 150 being selectively pulled out and used.

The cosmetic powder case 100 will now be described in more detail.

A space 111 for storing powder is formed in the cylindrical case main body 110. The male screw part 112 is formed along the upper circumferential surface of the case main body 110, and the stop protrusion 113 is formed in the upper portion thereof.

The male screw part 112 is coupled to the female screw part 132 of the cap 130. When the sifter 120 is fitted into the case main body 110, the stop protrusion 113 supports the sifter 120 to prevent the sifter 120 from being dropped downward.

The sifter 120 includes the powder discharge holes H in the bottom surface thereof, and the puff P is placed on the bottom surface. A certain amount of powder is applied to the puff P through the powder discharge holes H.

The cap 130 including the female screw part 132 along the inner circumferential surface thereof to couple to the upper portion of the case main body 110, the rotation guide 133 along the outer top surface thereof, and the guide recess 134 in the inner surface of the rotation guide 133.

Openings 133*a* and 133*b* are formed by cutting left and right portions of the rotation guide 133. The guide recess 134 is provided in plurality at the front and rear sides of the openings 133*a* and 133*b* (along a Y axis), and are formed in the inner surface of the rotation guide 133. An insertion recess 135 is formed above the guide recess 134.

The brush holder 140 is rotatably coupled to the inner portion of the rotation guide 133.

A flange 142*d* contacting the upper end of the rotation guide 133 is disposed at an upper edge of the brush holder 140. A knurling portion 142*e* is formed on an outer surface of the flange 142*d*. The knurling portion 142*e* makes it possible for a user to rotate the brush holder 140 without a slip.

The guide protrusion 141 is formed on the outer circumferential surface of the brush holder 140 to correspond to the guide recess 134.

The insertion recess 135 facilitates inserting of the guide protrusion 141 into the guide recess 134 when the brush holder 140 is coupled to the inner portion of the rotation guide 133.

The brush insertion part 142 is formed in the upper portion of the brush holder 140.

A brush inlet 142*a* and a brush outlet 142*b* are formed at the left and right sides of the brush insertion part 142 (along an X axis) to correspond to the openings 133*a* and 133*b*.

An exposure hole 142*c* is formed in the upper portion of the brush insertion part 142 to expose the handle 151 of the brush 150 out of the brush holder 140, so that the brush 150 can be easily taken out.

The handle 151 exposed through the exposure hole 142*c* is pressed and pushed with a user's hand to slide the brush 150, whereby the brush 150 can be easily taken out from the brush holder 140.

When the openings 133*a* and 133*b*, the brush inlet 142*a*, and the brush outlet 142*b* are aligned in the left and right direction (along the X axis) (in an open state), the brush 150 can be slid, and taken out from the brush holder 140.

When the openings 133*a* and 133*b*, the brush inlet 142*a*, and the brush outlet 142*b* are not aligned in the left and right direction, and the openings 133*a* and 133*b* are aligned along the Y axis (in a closed state), the brush 150 is prevented from being accidentally removed from the brush insertion part 142.

The brush 150 including the handle 151 and the hairs 157 fixed to the handle 151 is inserted and stored in the brush insertion part 142, and is selectively pulled out and used.

A tension piece 142*g* for fixing the brush 150 is formed on a bottom surface 142*f* of the brush insertion part 142. Fixing recesses 151*a* are formed in top and bottom surfaces of the handle 151 to correspond to the tension piece 142*g*.

An aligning recess 151*b* for guiding sliding of the brush 150 is formed on a center line L of the handle 151.

A fixing protrusion 134*a* for fixing the guide protrusion 141 is formed on a bottom of the guide recess 134.

Hereinafter, an operation of the cosmetic powder case 100 configured as described above will now be described.

A certain amount of powder is stored in the space 111 of the case main body 110, and a portion of the powder is supplied through the powder discharge holes H of the sifter 120. Then, a user uses the puff P or the brush 150 to apply the powder to her face.

To store the brush 150 in the brush insertion part 142, the user holds and rotates the brush holder 140.

Since the guide protrusion 141 is inserted in the guide recess 134, the brush holder 140 smoothly rotates. At this point, the openings 133*a* and 133*b*, the brush inlet 142*a*, and the brush outlet 142*b* are aligned with one another.

Then, the handle 151 of the brush 150 is inserted through the brush inlet 142*a*. When the brush 150 is further inserted, the tension piece 142*g* is elastically inserted in the fixing recess 151*a* of the handle 151 so as to prevent an accidental movement of the brush 150.

The brush holder 140 is held and rotated reversely. The guide protrusion 141 is fixed to the fixing protrusion 134*a* to prevent an accidental rotation of the brush holder 140. At this point, the openings 133*a* and 133*b* are not misaligned with the brush inlet 142*a* and the brush outlet 142*b*.

Accordingly, the rotation guide 133 closes the brush inlet 142*a* and the brush outlet 142*b* so as to prevent an accidental removal of the brush 150 from the brush insertion part 142, and thus, the brush 150 is securely stored in the brush insertion part 142, and is prevented from being lost.

When the brush 150 is taken out for a makeup, the brush holder 140 is held and rotated. At this point, the openings 133*a* and 133*b*, the brush inlet 142*a*, and the brush outlet 142*b* are aligned with one another. The handle 151 is pressed through the exposure hole 142*c*, and is slid to take out the brush 150 through the brush outlet 142*b*.

As described above, according to the embodiments of the present invention, a brush holder is rotatably installed on a cap, and a brush is inserted and stored in the brush holder, thereby effectively preventing the brush from being lost. In addition, a structure for storing the brush is simplified, to thereby significantly decrease mold costs.

In addition, the brush can be conveniently taken out for a makeup, and be inserted and be stored in a brush insertion part of the brush holder. Since a handle of the brush is exposed out of the brush holder, the handle can be pressed and be easily taken out with a user's hand.

In addition, a tension piece makes it possible to securely store the brush in the brush insertion part without a movement.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A cosmetic powder case comprising:

a cylindrical case main body (110) for storing powder, and including a male screw part (112) along an upper circumferential surface thereof, and a stop protrusion (113) in an upper portion thereof;

a sifter (120) supported by the stop protrusion (113) and coupled to the upper portion of the case main body (110), the sifter (120) including powder discharge holes (H) in a bottom surface thereof, the bottom surface being capable of accommodating a puff (P) placed thereon;

a cap (130) including i) a female screw part (132) along an inner circumferential surface thereof to couple to the upper portion of the case main body (110), ii) a rotation guide (133) along an outer top surface thereof, and iii) a guide recess (134) in an inner surface of the rotation guide (133);

a brush holder (140) having a rotational axis and rotatably coupled to an inner portion of the rotation guide (133), and including a guide protrusion (141) on an outer circumferential surface thereof to correspond to the guide recess (134), and a brush insertion part (142) in an upper portion thereof; and a brush (150) including a handle (151) and hairs (157) fixed to the handle (151), and insertable and storable in the brush insertion part (142), the brush (150) being selectively pulled out and used, wherein openings (133*a* and 133*b*) are formed in left and right portions of the rotation guide (133), a brush inlet (142*a*) and a brush outlet (142*b*) are formed at left and right sides of the brush insertion part (142) to correspond the openings (133*a* and 133*b*), wherein when the openings (133*a* and 133*b*), the brush inlet (142*a*), and the brush outlet (142*b*) are aligned in a left and right direction in a brush open state, the brush (150) is able to be i) slid transversely in relation to the rotational axis of the brush holder (140) and ii) taken out from the brush holder (140);

an exposure hole (142*c*) is formed in an upper portion of the brush insertion part (142) to expose the handle (151) of the brush (150) out of the brush holder (140), so that the brush (150) is able to be taken out, the handle (151) exposed through the exposure hole (142*c*) is pressed and pushed with a user's hand to slide the brush (150), whereby the brush (150) is taken out from the brush holder (140).

2. The cosmetic powder case of claim 1, wherein when the openings (133*a* and 133*b*), the brush inlet (142*a*), and the brush outlet (142*b*) are not aligned in the left and right direction in a brush closed state, the brush (150) is prevented from being accidentally removed from the brush insertion part (142).

3. The cosmetic powder case of claim 1, wherein a flange (142*d*) contacting the rotation guide (133) is formed at an upper edge of the brush holder (140), a knurling portion (142*e*) is formed on an outer surface of the flange (142*d*), and an insertion recess (135) is formed above the guide recess (134) to insert the guide protrusion (141) into the guide recess (134) when the brush holder (140) is coupled to the inner portion of the rotation guide (133).

4. The cosmetic powder case of claim 1, wherein a tension piece (142*g*) for fixing the brush (150) is formed on a bottom surface (142*f*) of the brush insertion part (142), a fixing recess (151*a*) is formed in the handle (151) to correspond to the tension piece (142*g*), an aligning recess (151*b*) for guiding sliding of the brush (150) is formed on a center line (L) of the handle (151), and a fixing protrusion (134*a*) for fixing the guide protrusion (141) is formed on a bottom of the guide recess (134).

* * * * *